United States Patent [19]

Knott, Sr.

[11] Patent Number: 4,817,553

[45] Date of Patent: Apr. 4, 1989

[54] CRAWFISH HARVESTING BOAT

[76] Inventor: Russell J. Knott, Sr., Rt. 2, Box 87, Arnaudville, La. 70512

[21] Appl. No.: 35,762

[22] Filed: Apr. 8, 1987

[51] Int. Cl.[4] ..... B63B 35/14

[52] U.S. Cl. ..... 114/255; 43/6.5

[58] Field of Search ..... 43/6.5, 27.2, 27.4; 114/255

[56] References Cited

U.S. PATENT DOCUMENTS

| | | | |
|---|---|---|---|
| 1,923,090 | 8/1933 | Hiller | 43/6.5 |
| 2,413,918 | 1/1947 | Harris | 43/6.5 |
| 2,513,004 | 6/1950 | Cooley | 43/6.5 |
| 3,909,971 | 10/1975 | Wilde | 43/6.5 |
| 4,013,029 | 3/1977 | Rhody | 114/255 |
| 4,033,280 | 7/1977 | Wood | 114/255 |
| 4,442,786 | 4/1984 | Conners | 43/6.5 |
| 4,476,798 | 10/1984 | Backus | 114/255 |

*Primary Examiner*—Kurt Rowan

*Attorney, Agent, or Firm*—Penrose L. Albright; Robert A. Miller

[57] ABSTRACT

A multipurpose flat bottom boat for harvesting crawfish. The boat includes a deck on each end with an open-spaced hull between the decks. The boat is propelled by rotatable wheels engaging the bottom of a body of water which may have a propelling units on their ends and are mounted on telescopically extensible members. The units may be mounted on one or both ends of the boat. The boat is equipped with supports on each side for supporting a seine on each side thereof. Oppositely disposed trays are fitted above the open spaced hull and crawfish receiving containers are placed in the open-spaced hull. The crawfish are caught by dropping the seines into the body of water on each side of the boat. The seines moved along the bottom for a distance and then are lifted from the water and the crawfish are dumped into the trays which have been moved to a position with half of the tray disposed over the water. The crawfish are washed, then sorted according to size and dropped into the containers. The containers can then be lifted from the hull and the sized crawfish delivered to customers without further processing.

8 Claims, 4 Drawing Sheets

CRAWFISH HARVESTING BOAT

BACKGROUND OF THE INVENTION

This invention relates to crawfish harvesters and more particularly to the use of a flat bottom boat powered by an electric motor or by hydraulic driven spiked wheels, by water under pressure or other suitable means.

Heretofore crawfish have been harvested by the use of traps which trap the crawfish. The traps are then gathered manually and the crawfish are deposited into a boat by persons walking in the water beside the boat or by picking up the traps while on the boat. Such boats have been driven by spiked wheels. The process, however, is not useful in very shallow water because the boat may get stuck and require undue time to release. The above process is very time consuming and requires considerable manual labor for lifting and dumping the traps. Also, substantial effort is required to move from one pond to another, sometimes damaging the levee.

One labor saving device is disclosed in U.S. Pat. No. 4,563,830 by which crawfish may be harvested from a pond by mechanical means.

SUMMARY OF THE INVENTION

The present invention is directed to a flat bottom boat which is propelled by one or more driven wheels which may be powered by any appropriate means. The driven wheels are mounted on telescopic, pivotable arms by which the wheels are adjusted to different depths and different distances from the boat. The boat has a storage section and is provided with a seine on each side which is used to harvest the crawfish. Means are provided for washing and then separating the crawfish by size so that when the harvesting is finished, the crawfish are sized and ready for shipping directly from the boat.

It is therefore an object of the invention to provide an apparatus and method of harvesting crawfish which is less time consuming and which employs considerably less manual labor than existing methods and apparatus.

Another object is to provide means for catching crawfish, washing them, and separating them for market during the harvesting period.

Still another object is to provide a means for harvesting crawfish in very shallow water as well as in deeper water.

Yet another object is to provide a crawfish harvester which can be used to cross deep lakes, shallow ponds and even cross levees without damage to the levee.

Still other objects are to reduce harvesting time, reduce labor requirements, do away with requirements for large amounts of bait, avoid expenses of making and repairing traps or cages, and to avoid the craft becoming stuck in the mud.

Another object is to provide a boat which has facilities adapted for different attachments for different types of work.

Other objects and advantages will become obvious from the drawings as set forth in the detailed description

DESCRIPTION OF THE PREFERRED EMBODIMENTS

Figure 1:
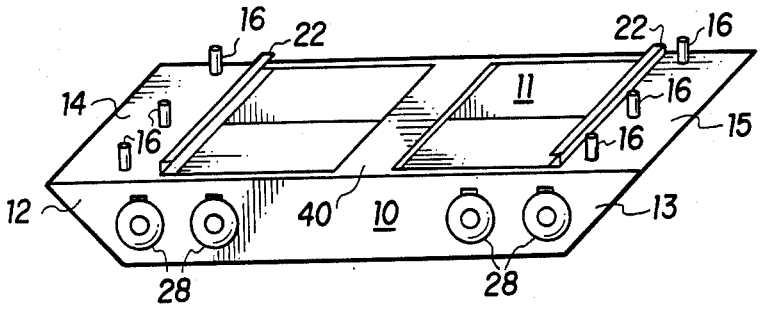
FIG. 1 illustrates the hull of the flat bottom boat without the top side accessories.
Figure 2:
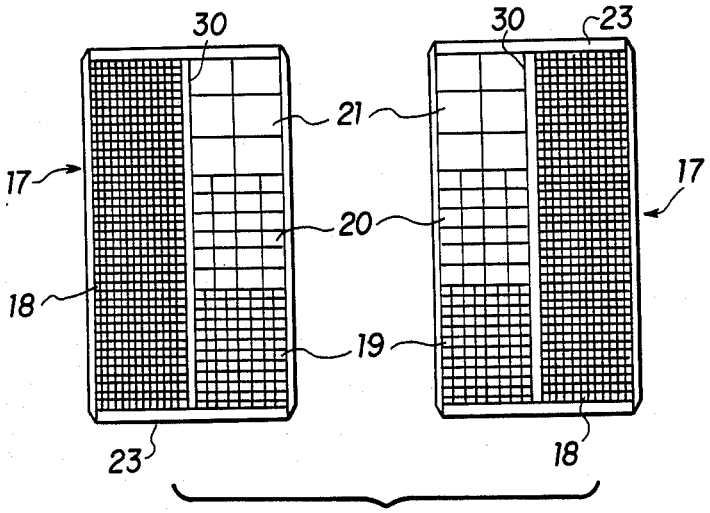
FIG. 2 illustrates a type tray to be used for washing and then sorting the crawfish according to size.
Figure 3:
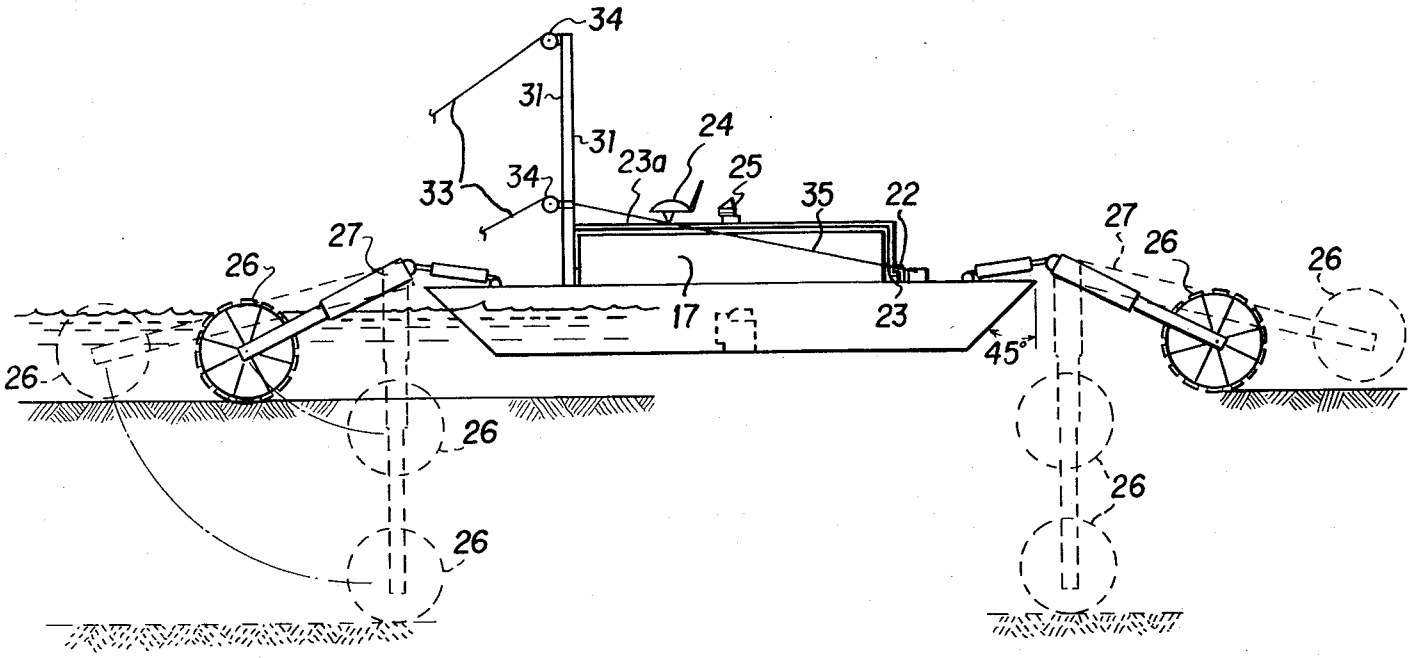
FIG. 3 is a side elevational view of the finished flat bottom boat with the different accessories fixed in place.
Figure 4:
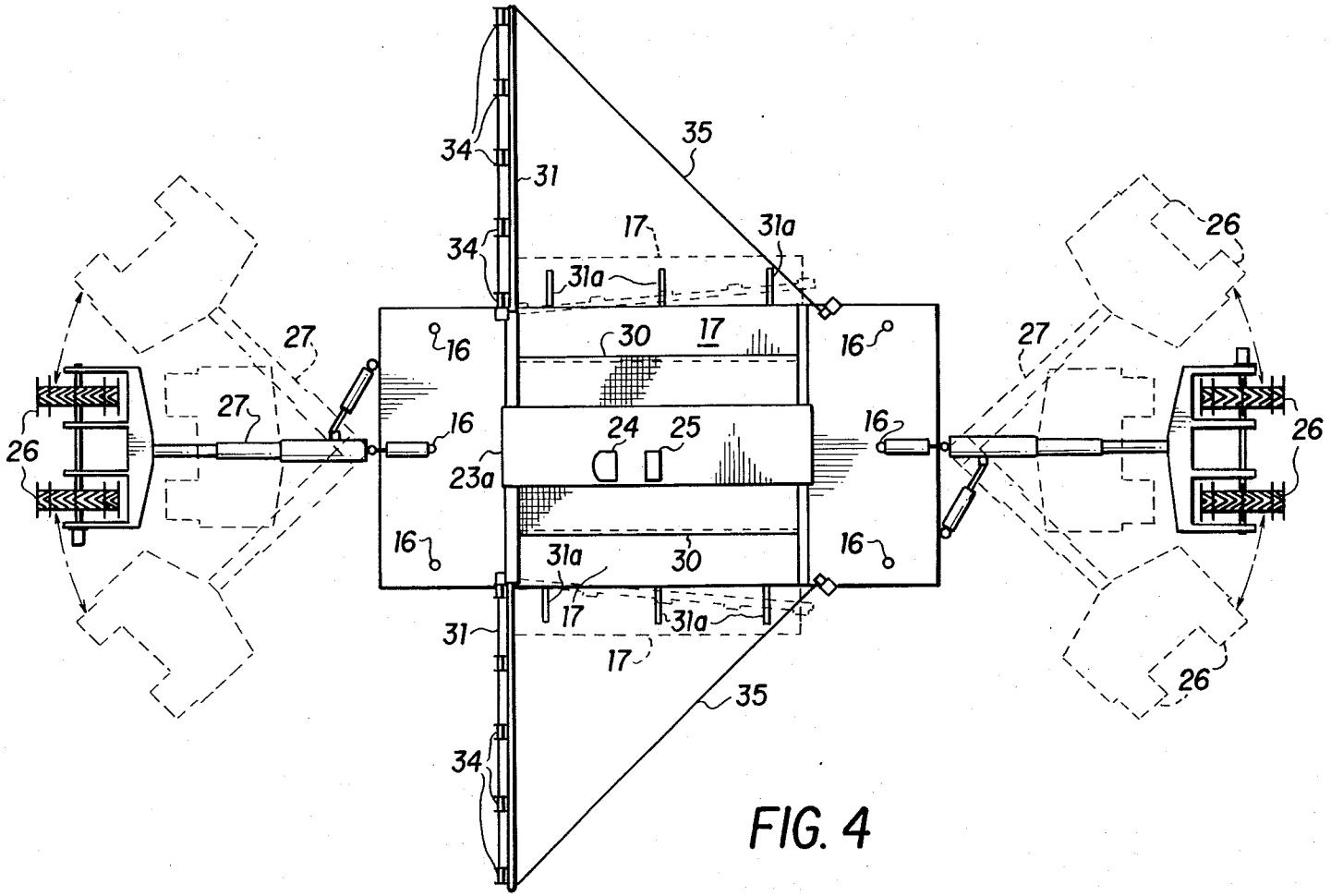
FIG. 4 is a top plan view with the accessories in place.
Figure 5:
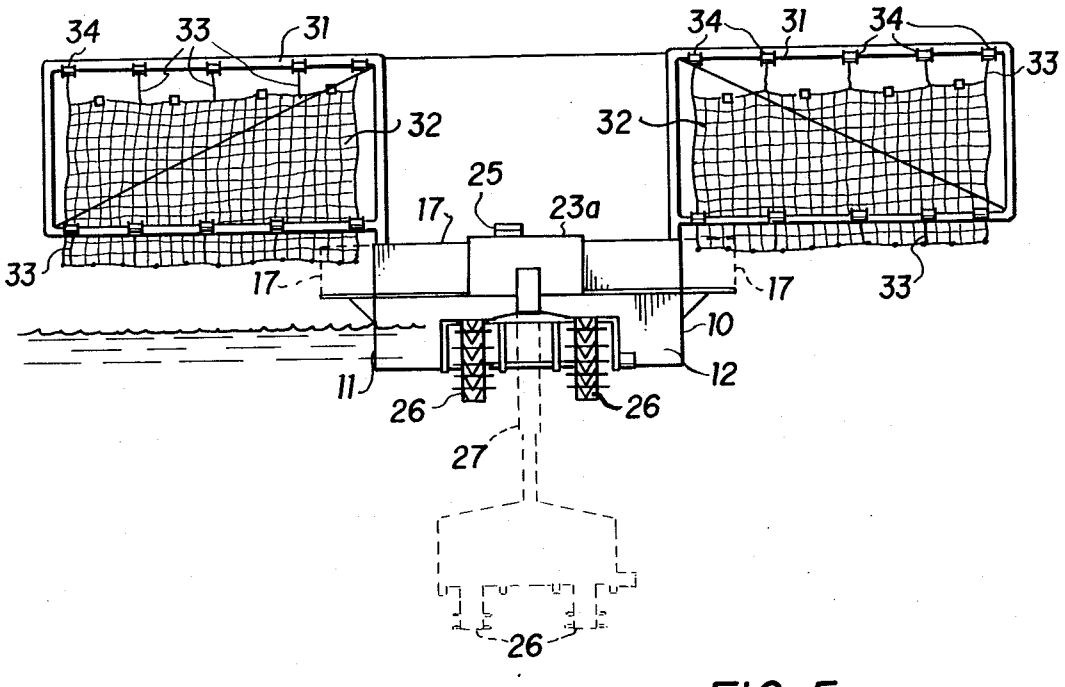
FIG. 5 is a front elevational view.

Referring to the drawings, where like parts are identified by the same reference characters, there is shown in FIG. 1 a hull including sides 10, 11; ends 12, 13; and end decks 14, 15 below which are found hydraulic fluid tanks, hydraulic and/or electric motors for operation of the different accessories. Hydraulic connections 16 on each end connect to various operational elements as will be described later. The central section between the end decks is used to store the crawfish after they have been brought aboard and sorted by size. The crawfish are caught by use of nets shown in FIGS. 4–5 and then dumped onto the wire screen trays 17 on each side of the boat. The crawfish are cleaned, in wire screened trays 17, by spraying with high pressure water and then placed into different boxes or canisters according to size. The wire screen trays are made so that the outer half 18 receives the crawfish for washing and the innermost half has screens with different sized openings so that the smaller crawfish fall through the narrow openings 19, the medium sized crawfish fall through the middle sized openings 20, and the larger crawfish will fall through the larger openings 21. Different sized containers are placed under the different sized wire screens for directly receiving the crawfish therein which will be ready for shipping. A removable baffle 30 separates the two halves from each other. The open space between the decks on each end are provided with an angle iron 22 across its width which is fixed in place along side the decks and so positioned that an angle iron 23 on the bottom edge of the ends of the trays slides along the angle iron 22 so that the trays do not tip when they are pulled out for receiving and washing the crawfish as shown in dotted line in FIGS. 4 and 5. During washing of the crawfish, the trays extend over the edges of the hull so that the wash water drains outboard and is not received in the boat as shown in FIGS. 4 and 5. If necessary, supports 31*a* may be added to the sides of the hull for supporting the trays when they are pulled out for washing the crawfish.

In carrying out the invention, a raised deck 23*a* is assembled across the middle from the front end deck to the back end deck at a height sufficient for the trays 17 to pass under the raised deck. The raised deck supports the captain's chair 24 and the controls 25 for the different accessories. The boat is driven by use of spiked wheels 26 held in position by use of a hydraulically telescoping arm 27 which is well known in the art such as used for ditch diggers. The telescopic arm may be moved in and out for different arm lengths and may be moved both in a horizontal and vertical direction for different depths of water and for different drive angles. A drive wheel is preferably provided on each end of the boat for assistance in moving the boat in desired directions and in case one end of the boat gets stuck. Both end drives may be used to assist the boat in going over levees and in very shallow water.

In order to move across levees without damage to the levee and boat and for moving the boat on the ground surface the boat may be provided with hydraulically operated wheels 28 on each side of the hull which may be adjusted below the bottom of the boat for supporting the boat on wheels or the wheels may be raised up along sides above the bottom level of the boat for shallow water use.

The boat is provided with mechanically operated booms 31 or net supports by means of which nets or screens may be supported. The booms are movable so that they may be positioned perpendicular to the sides of the boat or parallel with the boat. When the boom is perpendicular to the boat nets 32 are lowered into the water to catch the crawfish. When the net is full of crawfish, the net is raised and the boom is rotated along side the boat so that the net may be emptied onto the trays. The nets are secured to ropes or cables 33 which are wound on a reel or reels 34 for lowering the nets into the water and for raising the nets after catching the crawfish. The booms are controlled mechanically by use of stabilizer cables 35 and tension bars which support the nets and which operate the booms. The net supports may have an upper and lower rod with supports in between so that the net or seine will be supported along an upper and lower edge. The lines or cables being so spaced, assist in keeping the net open to receive the crawfish when the net is in the water.

In operation, the boat is launched into the pond, the net supports are rotated perpendicular to the hull and the nets are lowered on each side of the boat and the boat is moved through the water pulling the nets along with the boat. The nets may be lowered to any desired depth. If desired, the boat may be provided with a noise maker or some means for exciting the crawfish so that the crawfish move out of their nesting places and are caught by the nets. Once the nets are sufficiently full of crawfish, the boat is stopped. The trays are moved so that they extend out over the sides of the boat, about half way of the width of the tray as shown in dotted line in FIGS. 4 and 5, and the nets are raised. The booms supporting the nets are rotated parallel with the boat so that the open end of the nets are over the outer portion of the trays. The crawfish are dumped onto the washing portion of the tray and washed. Once they are washed the crawfish are moved around the end of the baffle to the small width screen end where the small crawfish fall through the small opening. The remaining crawfish will be moved along toward the opposite end of the tray and the middle sized crawfish fall through the middle screen, then the larger crawfish will finally fall through the wide screen end of the tray. Alternatively, the baffle can be removed and the crawfish move directly across onto the inner screen where they fall through. The crawfish fall into boxes or canisters of any desired size which are held in the hold of the boat between the deck ends. When the proper sized boxes or containers are used the crawfish can be removed from the boat and delivered directly to the market without further sorting or handling. Once all the crawfish contained in the net have been dumped, the boom may be rotated parallel with the body and the nets lowered to catch more crawfish. The routine is then repeated until finished. The boat may, if desired, be equipped with lights for night time operation.

The boats are preferably constructed of aluminum, but may also be made of plastic or other material and of different sizes. But preferably, the boat is flat on its bottom end has a width of about ten feet with the length measuring about twenty-six feet at the upper edge and about twenty-two feet on its bottom length with an end angle of about forty-five degrees from the top end towards the bottom. The height of the sides are preferably from about thirty inches to about thirty-six inches. The end decks may be from about four feet to about five feet across the end width of the boat depending on the size of the hull. For support of the hull, a central divider wall 40 is placed within the open space across the width of the hull. Since the height of the sides are from about thirty inches to about thirty-six inches, the boxes or containers in which the crawfish are stored may be up to thirty inches tall. Boxes having a size of four feet by four feet may be used or even longer for quick unloading. Preferably the boxes are of a size to carry the weight of crawfish desired. The boxes or containers may be square, rectangular or round. They should have openings in the sides to allow air circulation and in the bottom to permit water to escape. Several tubular containers may be placed within a large box and filled therein. Such boxes or containers are preferably aluminum, but plastic or any other appropriate material may be used.

The tray for washing and sorting the crawfish has a length which is the length of the open space between the end decks and a width which is half the width of the hull. The height is such that it will pass under the raised decks. As set forth previously, the ends should be provided with an angle iron 23 to prevent tipping.

As previously mentioned, the boat is equipped with electric or hydraulic motors and mechanical elements for operation of the drive wheels on each end, the wash water pumps, the reels, pulleys, etc, for the boom and nets as well as other accessories with which the boat may be equipped. Motor, fuel, hydraulic fluid, electric generators, pump pressure water pumps, etc, are stored under the end decks and/or assembled on the raised decks with the control panel. When properly equipped, the boat is propelled, and all accessories such as the wheels, the nets, the washing and sizing trays, are operated and controlled from the control panel.

For operation in deep water the boat can be provided with hydraulically operated propellers or a water jet propulsion system which may be controlled for steering the boat.

It has been determined the boat, in accordance with the invention, operates well in water as shallow as two inches as well as in deep water. Therefore, the boat may be equipped for other uses than harvesting crawfish. It may be equipped with a hydraulic bushhog attachment for cleaning bayous and canals by cutting grass, water weeds, and lillies. It may also be provided with a wood saw for cuting limbs of trees. Since the boat is flat bottom, it can go to places that other boats cannot go for cutting tree limbs etc. Further, the boat may be provided with a hydraulic operated back hoe for lifting levees, etc. Thus, the boat may be used for many purposes other than harvesting crawfish.

The accessories may be connected to the different hydraulic outlets 16 for operation by hydraulic fluid or by electric motors, and the boat may be equipped with an electric generator for generating electricity and with a bilge pump for pumping water from the bottom of the boat as necessary.

This boat and accessories have been described as being useful for harvesting crawfish. It will be obvious to others that such a boat could be used for harvesting fish, crabs and shrimps.

The foregoing detailed description has been given for understanding by those skilled in the art and unnecessary limitations should not be understood therefrom.

Having disclosed my invention, which I claim as new and to be secured by Letters Patent of the United States is:

1. A multipurpose boat for harvesting crawfish which comprises, a. a flat bottom hull generally rectangular in configuration having a front deck and an aft deck across the upper ends of the width of the hull, b. an open space between said front and aft decks, c. said open space having a height and width of the hull, d. propulsion means for moving the boat within a body of water, e. support means for supporting a net on each side of said hull, f. means for moving said support means to a position substantially perpendicular to said hull for positioning said net to harvest the crawfish and to a position substantially parallel with said hull for emptying said net, g. means for receiving said crawfish from said net, h. means for washing said crawfish in said receiving means, and i. means for sorting said crawfish according to size and dispensing said assorted crawfish into different containers within said open space depending upon the size of the crawfish.

2. A multipurpose boat as claimed in claim 1 in which said means for moving said boat includes a rotatable wheel, said rotatable wheel being mounted on telescopic cylinders which are pivotable and extensible to different positions vertically and horizontally.

3. A multipurpose boat set forth in claim 1, in which said means for receiving said crawfish is a wire mesh screen having a mesh which prevents any crawfish from falling through the screen, and said sorting means is a screen having different mesh for each assorted size.

4. A multipurpose boat as set forth in claim 2, in which said means for receiving said crawfish is a wire mesh screen having a mesh which prevents any crawfish from falling through the screen, and said sorting means is a screen having different meshes for each sorted size.

5. A multipurpose boat as set forth in claim 1, wherein, said means for moving said boat is a spiked wheel or a forced water jet.

6. A multipurpose boat as set forth in claim 1, in which said means for receiving, washing, and sorting said crawfish extends from said front and aft decks above said open space in said hull to the mid plane of its length, said boat includes a raised deck between said front and aft ends which is above said means for receiving, washing, and assorting said crawfish according to size.

7. A multipurpose boat as claimed in claim 1, in which, said boat includes spaced, hydraulically driven retractable wheels along each side of said hull.

8. A multipurpose boat as claimed in claim 1, which includes means for operating a bushhog, a wood saw, and a backhoe.

* * * * *